US011612806B2

(12) United States Patent
Sheats et al.

(10) Patent No.: US 11,612,806 B2
(45) Date of Patent: Mar. 28, 2023

(54) MULTI-MODE AMUSEMENT GAME DEVICE

(71) Applicant: STERN PINBALL, INC., Elk Grove Village, IL (US)

(72) Inventors: Lyman F. Sheats, Hoffman Estates, IL (US); Michael X. Vinikour, Downers Grove, IL (US)

(73) Assignee: Stern Pinball, Inc., Elk Grove Village, IL (US)

( * ) Notice: Subject to any disclaimer, the term of this patent is extended or adjusted under 35 U.S.C. 154(b) by 0 days.

(21) Appl. No.: 16/190,259

(22) Filed: Nov. 14, 2018

(65) Prior Publication Data

US 2019/0184273 A1 Jun. 20, 2019

Related U.S. Application Data

(60) Provisional application No. 62/586,483, filed on Nov. 15, 2017.

(51) Int. Cl.
*A63F 7/02* (2006.01)
*A63F 9/24* (2006.01)

(52) U.S. Cl.
CPC ..... *A63F 7/027* (2013.01); *A63F 2009/247* (2013.01); *A63F 2009/2451* (2013.01)

(58) Field of Classification Search
CPC ..... A63F 7/027; H04N 5/45
USPC ..... 273/118 A
See application file for complete search history.

(56) References Cited

U.S. PATENT DOCUMENTS 4,162,793 A 7/1979 Cummings
5,149,094 A * 9/1992 Tastad ..... A63F 7/027 273/118 A
5,338,031 A 8/1994 Patla, Sr. et al.
5,913,516 A * 6/1999 Piotrowski ..... A63F 7/027 273/121 A
6,158,737 A 12/2000 Cornell et al.
8,248,534 B2 * 8/2012 Osawa ..... H04N 5/44591 348/564

(Continued)

OTHER PUBLICATIONS

Jersey Jack Pinball, Operations Manual for "The Hobbit" pinball machine, published Dec. 2016, pp. A12-A18, C6-C9, C15, C44-C45, C69-C72, D76-D77, D111, and E12 (Year: 2016).*

(Continued)

*Primary Examiner* — Laura Davison
(74) *Attorney, Agent, or Firm* — Greenberg Traurig, LLP

(57) ABSTRACT

A display device of an amusement game is caused to present in a main screen information associated with a first one of a plurality of active game play modes of the amusement game and to present in a secondary screen information associated with a second one of the plurality of active game play modes of the amusement game. A plurality of lighted features and at least one sound generating device are controlled using instructions that are associated only with the first one of the plurality of active game play modes while input received by a plurality of game play devices, resulting from an interaction between the plurality of game play features and an object that is moving relative to a playfield of the amusement game, is used to affect play of and/or scoring of play of the amusement game using instructions that are associated with each of the plurality of active game play modes.

6 Claims, 3 Drawing Sheets

(56) References Cited

U.S. PATENT DOCUMENTS 8,863,187 B2 * 10/2014 Ho ..... H04N 5/44591
725/43
2007/0026918 A1 2/2007 Sheats, Jr.

OTHER PUBLICATIONS

IE Pinball, YouTube video, "The Hobbit Pinball—v2.0 Gameplay—Long Game", published Jun. 30, 2017 (Year: 2017).*
Jersey Jack Pinball, "The Hobbit" Operations Manual, published Dec. 2016, pp. A12-A18, C6-9, C15, C44-C45, C69-72, D76-D77, D111, and E12,available online at www.ipdb.org/files/6223/2016_The_Hobbit_Limited_Edition_Operations_Manual_Release_3_0_December_2016_OCR_searchable_with_schematics.pdf (Year: 2016).*
Mission Pinball Framework v0.30-0.33 User Documentation, https://docs.missionpinball.org/en/latest/game_logic/modes/index.html, digitally archived May 19, 2017 (Year: 2017).*
Jersey Jack Pinball, "The Hobbit" Operations Manual, published Dec. 2016, p. A7, available online at www.ipdb.org/files/6223/2016_The_Hobbit_Limited_Edition_Operations_Manual_Release_3_0_December_2016_OCR_searchable_with_schematics.pdf (Year: 2016).*

* cited by examiner

MULTI-MODE AMUSEMENT GAME DEVICE

RELATED APPLICATION INFORMATION

This application claims the benefit of U.S. Provisional Application No. 62/586,483, filed on Nov. 15, 2017, the disclosure of which is incorporated herein by reference in its entirety.

BACKGROUND

Amusement game devices, such as pinball machines, redemption games, etc., of the commercial, e.g., revenue generating, and non-commercial, e.g., home entertainment, type are well known in the art. By way of example, U.S. Pat. Nos. 5,338,031, 6,158,737, and U.S. Published Application No. 2007/0026918 illustrate and describe amusement game devices of the type having a cabinet which houses a playfield.

In addition, U.S. Pat. No. 4,162,793 illustrates and describes a pinball machine that includes an operator selectable score altering mode on a given ball, for example a "double or nothing" scoring feature. A plurality of targets is associated with the selection and two registers are provided for monitoring game score as well as ball score for the play on the given ball. The success or failure of the ball impacting the targets is monitored and, at the conclusion of play on the given ball, the game score register is altered by the contents of the ball score register.

While each of these publications, which are incorporated herein by reference in their entirety, describe amusement devices that work for their intended purpose, the following describes an improved multi-mode feature of an amusement device.

SUMMARY

The following describes a multi-mode amusement game. Generally, a display device of the amusement game is caused to present in a main screen information (e.g., video, scoring, objectives, and/or the like) that is associated with a first one of a plurality of active game play modes of the amusement game and to present in a secondary screen information that is associated with a second one of the plurality of active game play modes of the amusement game. A plurality of lighted features (e.g., playfield lighting, target lighting, and/or the like) and at least one sound generating device are controlled using instructions that are associated only with the first one of the plurality of active game play modes while input received by a plurality of game play devices (e.g., bumpers, switches, and/or the like), resulting from an interaction between the plurality of game play features and an object that is moving relative to a playfield of the amusement game, is used to affect play of and/or scoring of play of the amusement game using instructions that are associated with each of the plurality of active game play modes.

A better understanding of the objects, advantages, features, properties and relationships of a multi-mode amusement game will be obtained from the following detailed description and accompanying drawings which set forth illustrative examples which are indicative of the various ways in which the principles of the subject multi-mode amusement game may be employed.

BRIEF DESCRIPTION OF THE DRAWINGS

For a better understanding of the subject multi-mode amusement game described hereinafter reference may be had to the following drawings in which.

DETAILED DESCRIPTION

With reference to the Figures, an amusement game device, in the exemplary form of a pinball machine 10 is now described. It is to be appreciated, however, that this exemplary form for the amusement game device 10 is not intended to be limiting. Rather, those of ordinary skill in the art will appreciate that the multi-mode game play feature described hereinafter can be utilized in any type of amusement game device of the commercial and non-commercial type.

Figure 1:
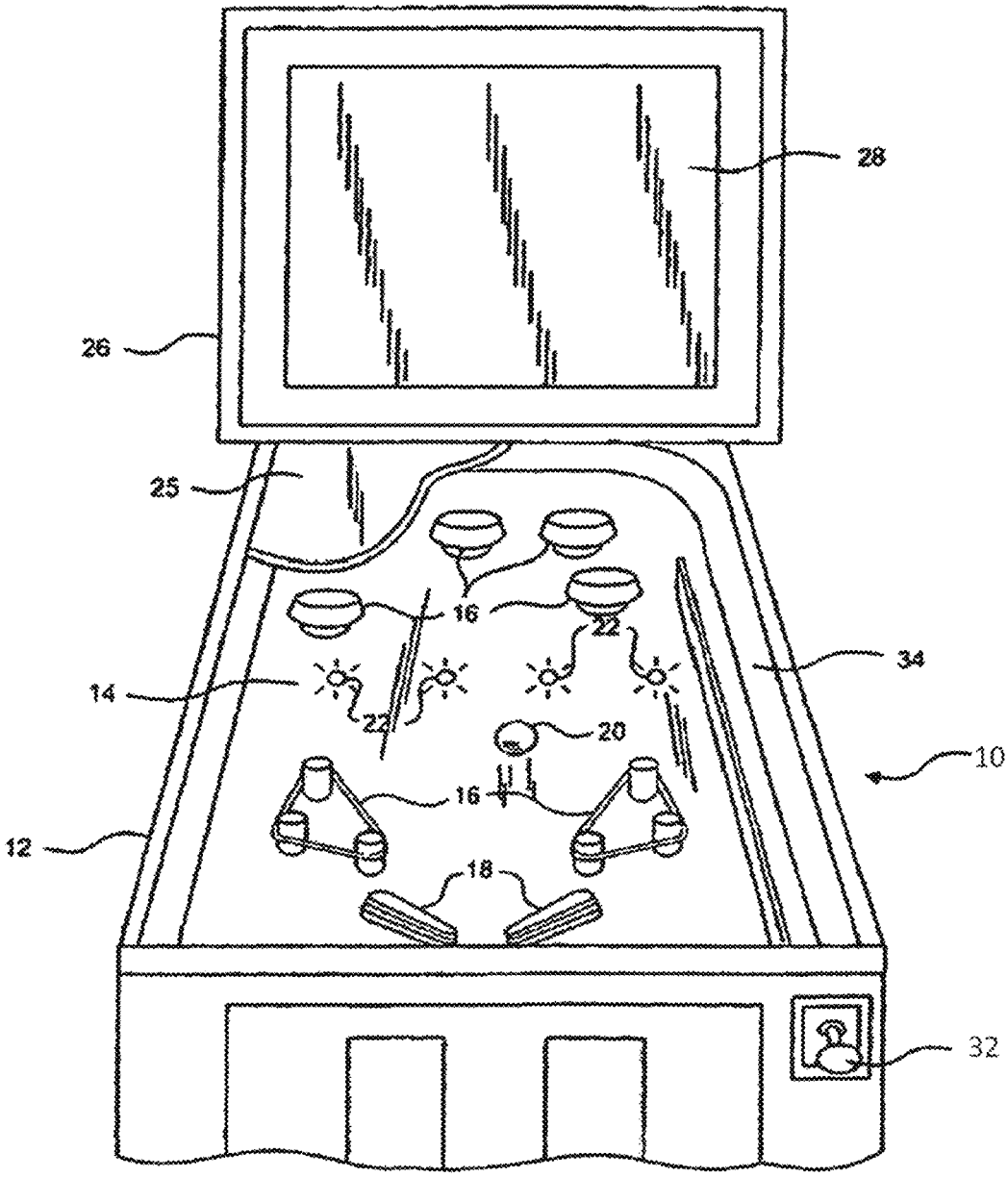
FIG. 1 illustrates an example amusement game device in the form of a pinball machine.

In keeping with the example of an amusement game device 10 of the pinball machine type, the amusement game device 10 illustrated in FIG. 1 includes a cabinet 12 which houses various apparatus used to define play of a game. Game play may be commenced in response to insertion of money—paper or coins referred to collectively as "coins"—into a coin accepting device, upon exercising of credits earned, by accepting payment from an account, e.g., via use of a swipe card reading device, a bar code reading device, a near field communications device, etc., and/or by otherwise making game play active. Upon activation of the game in this manner, an initial game play mode, in the case of a pinball machine, is defined upon an inclined playfield 14 that supports a number of playfield accessories or devices. More particularly, in the case of a pinball machine, game play in a given game play mode is generally defined through the use of a pair of flippers 18 to propel a ball 20 relative to the playfield 14 and input devices/accessories associated with the playfield 14. The playfield 14 is usually inclined from the horizontal such that the ball tends to eventually roll back down the playfield 14 in the direction of the flippers 18. While not intended to be limiting, the playfield accessories or input devices 16 may include elements such as bumpers, ramps, and/or targets as well as one or more rollover switches 22. The playfield 14 may be covered by a transparent or glass sheet cover 25 to permit viewing of the playfield 14. In addition to the foregoing, the playfield 14 includes a plunger element 32 which shoots the ball up an alley 34 onto the playfield 14. The playfield 14 may also include lighting elements and/or other features as desired. Other player-activated input elements, typically in the form of push-buttons on the sides of the cabinet 12, are usually provided for controlling operation of the flippers 18. The amusement game 10 may also include a backbox 26 which is mounted to overlay a top rear portion of the cabinet 12 and which contains a game display 28, such as a dot matrix display, CRT, LED or plasma display, or the like. The backbox 26 may also support one or more speakers associated with the game sound system. Within the backbox 26 may be located various ones of the electronic devices/circuits for controlling the operation of the playfield, the display, general illumination, and the sound system. Such electronic devices/circuits could also, in whole or in part, be carried within the game cabinet 12.

Figure 2:
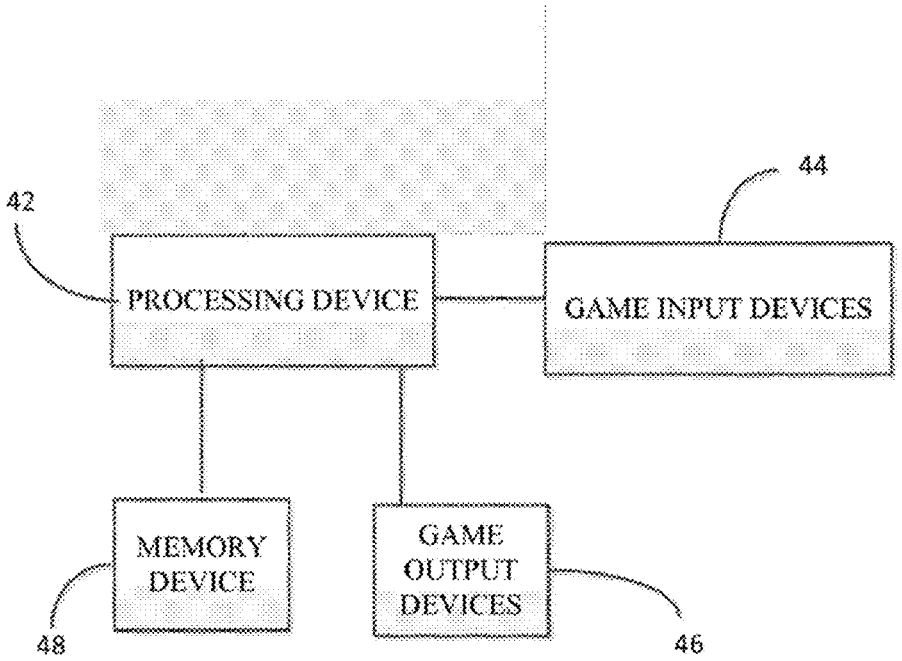
FIG. 2 is an example block diagram of exemplary components of the amusement game device of FIG. 1.

For controlling the various devices that form the amusement game 10, the amusement game 10 is provided with a processing device 42 which processing device 42 is, in turn, coupled to game input devices 44, such as switches associated with the cabinet 12, playfield 14, etc., and game output devices 46, such as lights, flippers 18, display 28, etc. via one or more bus systems as shown in FIG. 2. A memory device 48, such as a RAM, ROM, or the like, stores instructions and data usable by the processing device 42 to control play of the game, the game output devices 46, and the game input devices 44 as necessary, e.g., in accordance with various game play modes, based upon signals provided by the game input devices 44. It is to be understood that this illustrated embodiment is not intended to be limiting and that other manners for arranging the devices illustrated in FIG. 2 to provide for control of play of the amusement game can be utilized as needed.

During game play one or more game play modes may be active. In this regard, a game play mode generally defines a set of objectives that are to be obtained by the player, e.g., which targets that are to be hit, the order in which targets are to be hit, etc., defines the number of balls 20 that will be placed onto the playfield 14, defines the sounds and/or lighting to be presented to the player via use of the game output devices 46, etc. Thus, as known in the art, a game play mode generally determines the input devices 44 that are to be interacted with by the ball to affect further game play and/or scoring as well as the output devices 46 that are to be operated (and the manner of such operation). Furthermore, it is known that most modern pinball machines have lots of different game play modes and a player typically attempts to complete various modes throughout a game. Accordingly, many machines have lights on the playfield that show what modes have been completed so far, what modes are currently active, and/or what modes a player has yet to complete. While not required, a player might need to do something, e.g., hit one or more targets (sometimes in a sequence), to light a "start mode" shot and then, when that shot is made, the mode starts. Game play modes may also be started automatically, e.g., upon game start, ball launch, etc., or in response to user input, e.g., a button press or the like. A given game play mode generally runs for a while and, while it is running, there may be some kind of sub-goals associated with that game play mode, e.g., hit as many targets as you can, shoot a ramp, get as many pop bumper hits as possible, etc. Some game play modes run for a predetermined amount of time (e.g. 30 seconds) or until the ball drains, some game play modes are multiball and stop when there is only one ball left, some game play modes run until the ball ends, some game play modes run until you complete the mode's objectives, etc. Accordingly, within this document, a game play mode is intended to refer to any of these known forms of game play modes.

Figure 3:
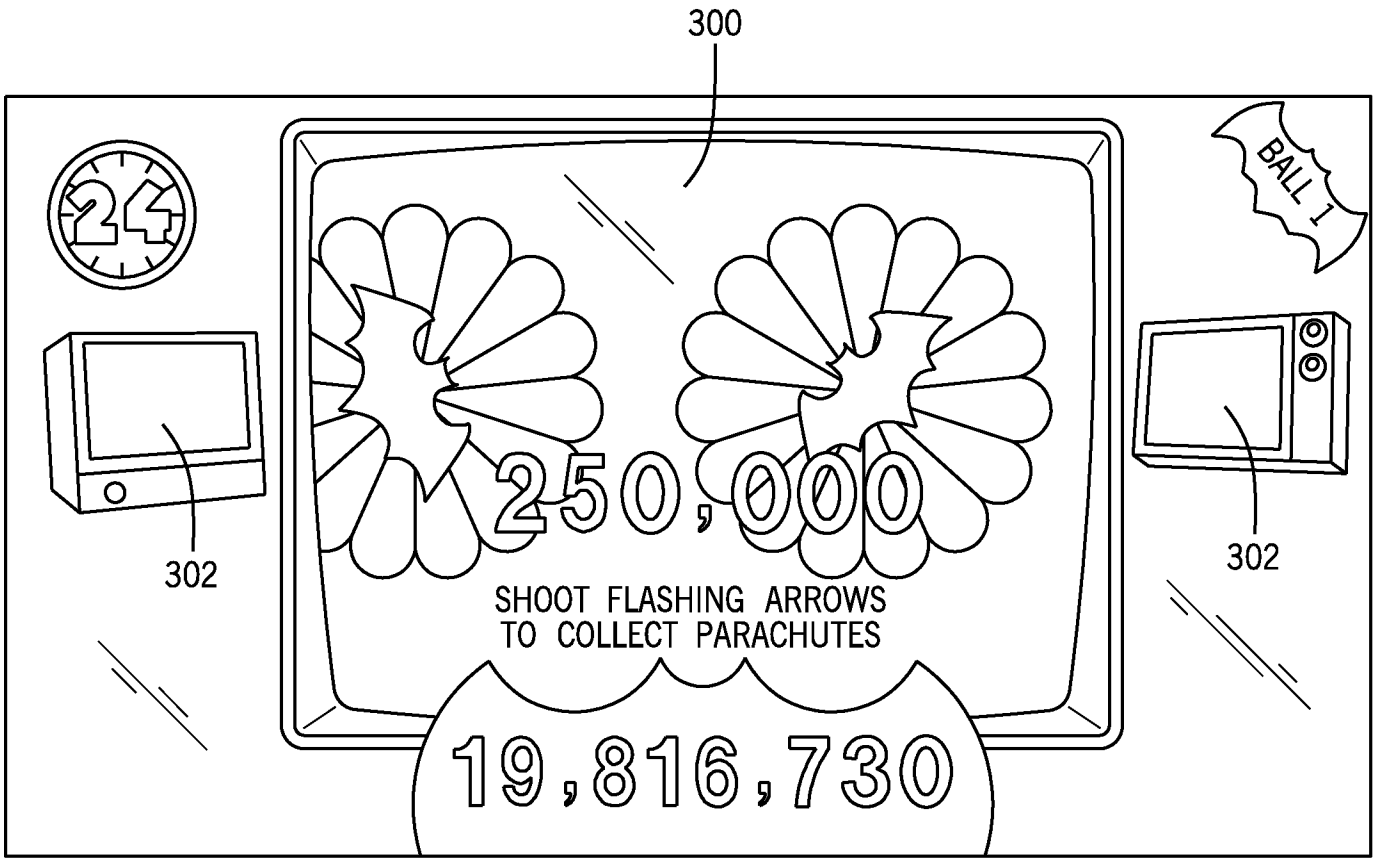
FIG. 3 is an image of an example display presented during multi-mode play of the amusement game device of FIG. 1.

To provide a means for a user to easily view details concerning an active game play mode, particularly when multiple game play modes are concurrently active on the amusement game device 10, the display 28 is caused (via use of the processing device and appropriate instructions stored in memory) to present a game play mode dependent display, an example of which is illustrated in FIG. 3. More particularly, the game play mode dependent display provides for the display of a "big screen" or main screen 300 for a selected one of plural, active game play modes while one or more "small screen" or secondary screens 302 for unselected ones of plural, active game play modes will also be displayed, for example to the side or sides of the main screen 300. As will be appreciated, if only one game play mode is currently active, the main screen 300 will preferably be displayed alone and, in this instance, may be displayed in the entirety of the display 28 as desired.

In a preferred example, the main screen 300 will display video, rules, and/or scoring associated with a selected one of plural, active game play modes while the output devices 46 are utilized in accordance with the programming that is also associated with the selected one of plural, active game play modes, e.g., lights are illuminated, sound/music is emitted from the speakers, etc. Furthermore, while the amusement game 10 is in one of the various game play modes, the user can start another game play mode (as described above) which further game play mode may automatically take over the main screen 300 (thus causing the prior game play mode to be automatically added to the display 28 as a secondary screen 302) or be automatically added to the display 28 as a secondary screen 302 as desired. In this manner, it will be appreciated that the player may view and follow their play of multiple game play modes, e.g., awards, video, objectives, rules, etc., via use of the display 28. As noted, it is preferred that, even when multiple game play modes are active on the amusement game device 10, the game play mode that is associated with the main screen 300 will control the music that is played, the lights that are made active, etc., even though the other game play modes will still be running, e.g., will continue to be scored and/or affected via interactions with playfield features. Furthermore, when a game play mode is caused to be ended, e.g., because all objectives have been met, the game play mode has timed out, the ball 20 has drained, etc., the screen 300 or 302 associated with that game play mode may be removed from the display 28. If the finished game play mode was being shown in the main screen 300, another game play mode would be moved from a secondary screen 302 to the main screen 300 and the amusement game 10 would control the output devices 46 accordingly, i.e., in accordance with the instructions associated with that game play mode. The game play mode that is selected for use in connection with the main image 300 in this case may be a one of plural remaining game play modes that was most recently associated with the main image 300, has the most objectives that have been met, or the like as desired. Thus, it will be appreciated that the secondary screens 302 will appear in and disappear from the display 28 as various game play modes start and finish.

To allow a user to determine which of various game play modes are to be associated with the main screen 300, a user may provide a predetermined input to the amusement device 10, e.g., activate a predetermined input element, speak a predetermined word, etc. By way of example, a player may hold down an action button on the lockdown bar for at least a ⅓ of a second which will cause the amusement device 10 to move the game play mode that is being displayed on a secondary screen 302 to the main screen 300 while moving the game play mode that is being displayed on the main screen 300 to a secondary screen 302. The movement of game play modes between the screens 300/302 can follow any desired pattern, e.g., clockwise, counter-clockwise, FIFO, or the like. Alternatively, a predetermined input can be associated with each secondary screen 302 that is being displayed and, upon receipt of that predetermined input, the game play mode associated with that secondary screen 302 can be swapped with the game play mode that is associated with the main screen 300. As noted above, when a new game play mode takes over the main screen 300, the sounds, e.g., music, etc., and playfield lights now change to reflect that game play mode. In this manner, a player can choose whichever game play mode he/she wants to be the main focus of the game while the other modes are running simultaneously (and the player is still making progress on those game play modes as the ball remains in play, i.e., input received via at least playfield input elements are utilized by the programming associated with each game play mode).

This also has the advantage of providing context-sensitive help as instructions may be displayed on the main screen 300 for any desired game play mode that is currently active. It is also to be understood that, while the main screen 300 is illustrated as being much larger than the secondary screens 302, the main screen 300 and secondary screens 302 can be provided with any size as desired.

To illustrate the foregoing by way of example it is considered that a player is currently in "The Joker" mode which is displayed on the main screen 300 on the LCD display 28 while the music and playfield lights currently running are the ones tied into that mode. When the player makes the lit shots, video clips play in the main screen 300. While this is happening, the player starts "Bat Turn" mode. "Bat Turn" now takes over the main screen 300 on the display, the "Bat Turn" music is now playing, and the "Bat Turn" shot arrows on the playfield take priority in being displayed. At this time, a secondary screen 302 pops up next to the main screen 300 and the secondary screen 302 shows the videos and scoring for the still-active "The Joker" mode. The player decides that he/she would prefer to have "The Joker" mode be the main focus of attention and likes the music better so he/she holds down an "action button" for ⅓ second to change "The Joker" mode back to the main screen 300 whereupon "Bat Turn" gets moved over to the secondary screen 302. While both of these game play modes are running the player starts "Multiball." "Multiball" now shows on the main screen 300, its music and playfield lamps are running, and "The Joker" and "Bat Turn" are both running on secondary screens 302 (two small screens are being displayed next to the big screen at this point). Now the player has one mode running on the main screen 300 and two on secondary screens 302 and he/she can toggle between them to determine what shows on the main screen 300 and what is on the secondary screens 302 any time by holding down the action button for ⅓ second.

While examples of the subject multi-mode amusement device have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalents thereof.

What is claimed is:

1. An amusement game, comprising:

a playfield comprising a plurality of game play devices and a plurality of lighted features, wherein the plurality of lighted features includes all lighted features associated with the playfield;

a user input element at least one sound generating device;

a display device;

a processor coupled to the plurality of game play devices, the plurality of lighted features the user input element, the sound generating device, and the display device; and a memory, coupled to the processor and storing instructions executable by the processor, the instructions, when executed by the processor, causing the amusement game to perform steps comprising:

receiving a first predetermined input indicative of an activation of a first one of a plurality of active game play modes of the amusement game;

causing the display device, in response to the activation of the first one of the plurality of active game play modes of the amusement game, to present in a main screen first information associated with the first one of the plurality of active game play modes of the amusement game;

receiving a second predetermined input indicative of an activation of a second one of the plurality of active game play modes of the amusement game after activation of the first one of the plurality of active game play modes;

causing the display device, in response to the activation of the second one of the plurality of active game play modes, to present in a secondary screen different from the main screen, the first information associated with the first one of the plurality of active game play modes of the amusement game and causing the display device to present in the main screen second information associated with the second one of the plurality of active game play modes of the plurality of active game play modes of the amusement game;

receiving a third predetermined input received directly from the user input element indicative of a user selection; and toggling, in response to receiving the third predetermined input, the display device whereby the display device presents in the main screen the first information associated with the first one of the plurality of active game play modes of the amusement game and presents in the secondary screen the second information associated with the second one of the plurality of active game play modes of the amusement game;

selectively illuminating the plurality of lighted features of the playfield such that the plurality of lighted features is illuminated using instructions that are associated with the one of the plurality of active game play modes that is associated with the information currently presented in the main screen;

controlling the at least one sound generating device using instructions that are associated with the one of the plurality of active game play modes that is associated with the information currently presented in the main screen; and using input received by the plurality of game play devices, resulting from an interaction between the plurality of game play devices and an object that is moving relative to the playfield, to affect play of and/or scoring of play of the amusement game using instructions that are associated with each of the plurality of active game play modes.

2. The amusement game as recited in claim 1, wherein the playfield comprises a pinball machine playfield and the object comprises a ball.

3. The amusement game as recited in claim 1, wherein the instructions cause the secondary screen to be removed from the display device upon completion of one of either of the first or the second one of the plurality active game play modes.

4. The amusement game as recited in claim 1, wherein the instructions cause the secondary screen to be removed from the display device upon completion of one of either of the first or the second one of the plurality of active game play modes and cause the display device to present in the main screen the information associated with the remaining one of either of the first or the second one of the plurality of active game play modes.

5. The amusement game as recited in claim 1, wherein the main screen is caused to be displayed larger relative to the secondary screen in the display device.

6. The amusement game as recited in claim 1, wherein the playfield is housed within a cabinet of the amusement game such that the plurality of game play devices and the plurality of lighted features are not directly accessible to a user of the amusement game, and further wherein the user input element comprises a selectable button positioned on an external surface of the cabinet such that the user input element is directly accessible to the user of the amusement game.

* * * * *